US009555637B2

(12) United States Patent
Kumagai et al.

(10) Patent No.: US 9,555,637 B2
(45) Date of Patent: Jan. 31, 2017

(54) CARTRIDGE AND LIQUID SUPPLYING METHOD

(71) Applicant: SEIKO EPSON CORPORATION, Tokyo (JP)

(72) Inventors: Masaru Kumagai, Nagano (JP); Yoshihiro Koizumi, Nagano (JP); Masaru Kobashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/079,221

(22) Filed: Mar. 24, 2016

(65) Prior Publication Data

US 2016/0288510 A1 Oct. 6, 2016

(30) Foreign Application Priority Data

Mar. 30, 2015 (JP) ..... 2015-068271

(51) Int. Cl.
*B41J 2/175* (2006.01)

(52) U.S. Cl.
CPC ..... *B41J 2/1752* (2013.01); *B41J 2/175* (2013.01); *B41J 2/17513* (2013.01); *B41J 2/17553* (2013.01); *B41J 2002/17516* (2013.01)

(58) Field of Classification Search
CPC .... B41J 2/17556; B41J 2/17513; B41J 2/1752
See application file for complete search history.

(56) References Cited

U.S. PATENT DOCUMENTS 5,157,421 A * 10/1992 Kitahara ..... B41J 2/1721 347/36
6,151,052 A * 11/2000 Yang ..... B41J 2/17503 347/87
2006/0055749 A1* 3/2006 Schuster ..... B41J 2/17513 347/86
2011/0018948 A1* 1/2011 Justice ..... B41J 2/175 347/86

FOREIGN PATENT DOCUMENTS

JP 2009-226809 A 10/2009

* cited by examiner

*Primary Examiner* — Julian Huffman
(74) *Attorney, Agent, or Firm* — Global IP Counselors, LLP

(57) ABSTRACT

A cartridge 1 is provided with an ink pack 9, an air bag 10 capable of abutting the ink pack 9, and a pressurizing chamber 11 that stores the ink pack 9 and the air bag 10. In the case where the amount of ink in the ink pack 9 decreases, pressurized air is introduced into the air bag 10, the ink pack 9 is pressed against the air bag 10, and thereby the internal pressure of the ink pack 9 is increased. After that, pressurized air is introduced into the pressurizing chamber 11 so as to increase the internal pressure of the pressurizing chamber 11 and pressurize the ink pack 9 from outside. Accordingly, the ink in the ink pack 9 is supplied from an ink supply port 12 to the inkjet printer 2.

7 Claims, 5 Drawing Sheets

CARTRIDGE AND LIQUID SUPPLYING METHOD

Priority is claimed under 35 U.S.C. §119 to Japanese Application No. 2015-068271 filed on Mar. 30, 2015 which is hereby incorporated by reference in its entirety.

BACKGROUND

1. Technical Field

The present invention relates to a cartridge that is mounted to a liquid jetting apparatus to supply a liquid, and a method for supplying a liquid.

2. Related Art

A cartridge that is mounted to a printer to supply ink is described in JP-A-2009-226809. The cartridge of JP-A-2009-226809 includes a case, an ink pack stored in the case, a flat plate attached to the ink pack, and a spring for biasing this flat plate. The ink pack includes a flexible storing bag for storing ink, and an ink supply tube for supplying the ink in the storing bag to the outside. The flat plate is attached to the storing bag. The spring is arranged between the flat plate and a bottom plate of the case, and presses the ink pack against the ceiling plate of the case via the flat plate. Accordingly, the storing bag is flattened between the flat plate and the ceiling plate, and thus the ink in the ink pack is supplied to the printer side via the ink supply tube.

In the cartridge of JP-A-2009-226809, the thickness of the ink pack in the vertical direction decreases as the amount of ink decreases. Here, when the thickness of the ink pack decreases, the spring extends by the reduced thickness, and thus biasing force of the spring upwardly biasing the flat plate is weakened. Therefore, there is a problem in that in the cartridge of JP-A-2009-226809, pressure for supplying the ink to the printer decreases as the amount of the ink decreases, and the supply thereof becomes instable.

SUMMARY

An advantage of some aspects of the invention is to provide a cartridge that can supply a liquid to a liquid jetting apparatus in a stable manner even in the case where the amount of this liquid in a flexible liquid container becomes low. In addition, another advantage of some aspects of the invention is to provide a method for supplying a liquid using such a cartridge.

According to an aspect of the invention that has been made in order to solve at least a part of the foregoing problem, a cartridge that is mountable to a liquid jetting apparatus to supply a liquid includes: a liquid storing part having a flexible liquid container that stores the liquid; an pressing part having a flexible container capable of abutting the liquid container; and a pressurizing chamber that stores the liquid storing part and the pressing part, wherein the liquid storing part includes a liquid supply port for supplying the liquid from the liquid container to the outside, the pressing part includes a pressing part side fluid flow port that introduces a fluid into the container, and the pressurizing chamber includes a pressurizing chamber side fluid flow port that introduces a fluid into the pressurizing chamber.

In the invention, when supplying a liquid to a liquid jetting apparatus, a fluid is introduced into the pressurizing chamber via the pressurizing chamber side fluid flow port. Thereby, the flexible liquid container is pressurized from outside. Therefore, the liquid in the liquid container is supplied to a side of the liquid jetting apparatus via the liquid supply port. Here, in the case where the amount of liquid in the liquid container deceases, if the fluid is introduced into the container via the pressing part side fluid flow port, the liquid container can be pressed by a pressing part (container). Therefore, due to the pressing force of the pressing part and the pressure of the fluid introduced into the pressurizing chamber, the pressure of the liquid to be supplied from the liquid supply port to the outside can be increased. Accordingly, it is possible to avoid a decrease in the pressure for suppling the liquid to the liquid jetting apparatus, and thus the liquid can be supplied in a stable manner.

In the invention, it is desirable that the liquid supply port is attached to a front end portion of the liquid container in a mounting direction, and the pressing part is capable of abutting a rear side portion of the liquid storing part in the mounting direction. With this configuration, a portion in the liquid container that is distant from the liquid supply port can be pressed by the pressing part. Therefore, the amount of liquid that is not supplied to the liquid jetting apparatus and remains in the liquid storing part can be reduced.

In the invention, it is desirable that pressing force of the pressing part pressing the liquid container due to fluid introduction is larger than or equal to an internal pressure of the pressurizing chamber. With this configuration, when the liquid container is pressurized from outside by introducing a fluid into the pressurizing chamber, the liquid container can be pressed by the container that is in a state in which the fluid has been introduced.

Next, according to another aspect of the invention, a liquid supplying method for supplying a liquid from the above-described cartridge that is mounted to a liquid jetting apparatus includes: introducing a fluid into the container via the pressing part side fluid flow port to cause the container to expand and press the liquid container; and introducing a fluid into the pressurizing chamber via the pressurizing chamber side fluid flow port to cause the liquid container to contract and supply the liquid from the liquid supply port to the liquid jetting apparatus.

According to the invention, in the state where the internal pressure of the pressurizing chamber is low, a fluid is introduced into the container to cause the container to expand. Therefore, it is easy to cause the container to expand. Accordingly, it becomes easy for the pressing part to press the liquid container.

In this case, it is desirable that the pressurizing chamber side fluid flow port is put into communication with atmospheric air and the pressurizing chamber is opened to atmospheric air before the fluid is introduced into the container. With this configuration, it becomes easier to cause the container to expand.

In the invention, it is desirable the fluid is introduced into the container via the pressing part side fluid flow port after the liquid amount of the liquid in the liquid storing part falls below a set liquid amount that was set in advance. With this configuration, a space for allowing the container to expand can be provided in the pressurizing chamber, thus making it easy to cause the container to expand.

BRIEF DESCRIPTION OF THE DRAWINGS

The invention will be described with reference to the accompanying drawings, wherein like numbers reference like elements.

DESCRIPTION OF EXEMPLARY EMBODIMENTS

A cartridge that is an embodiment of the invention will be described below with reference to the drawings.

Overall Configuration of Cartridge

Figure 1A:
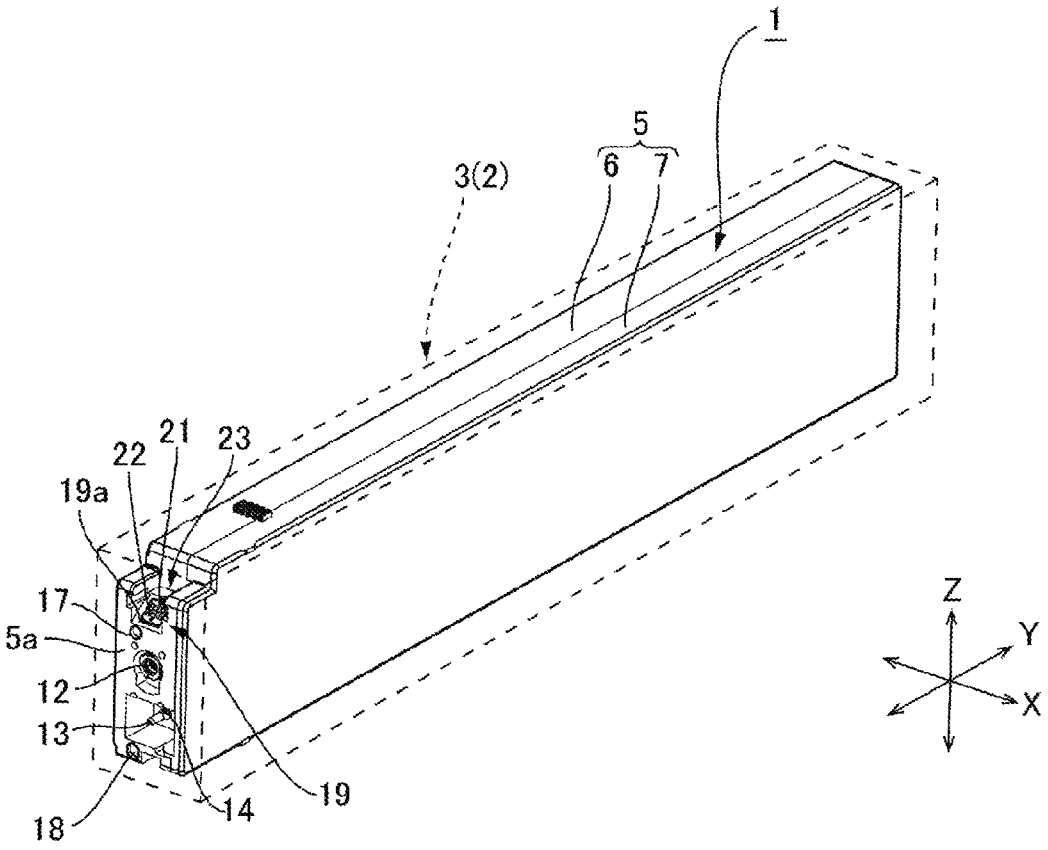
FIGS. 1A and 1B are respectively a perspective view and a front elevational view of a cartridge to which the invention is applied.
Figure 1B:
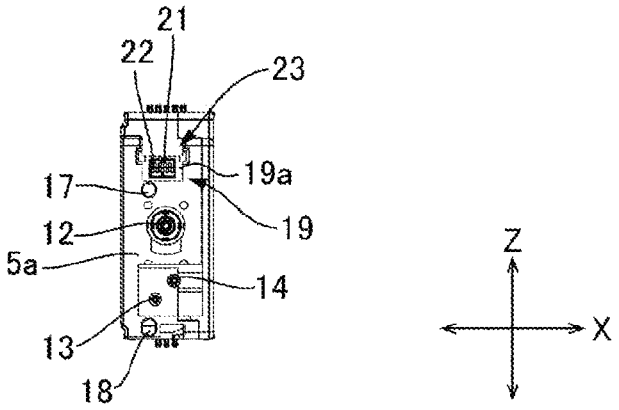
Figure 2A:
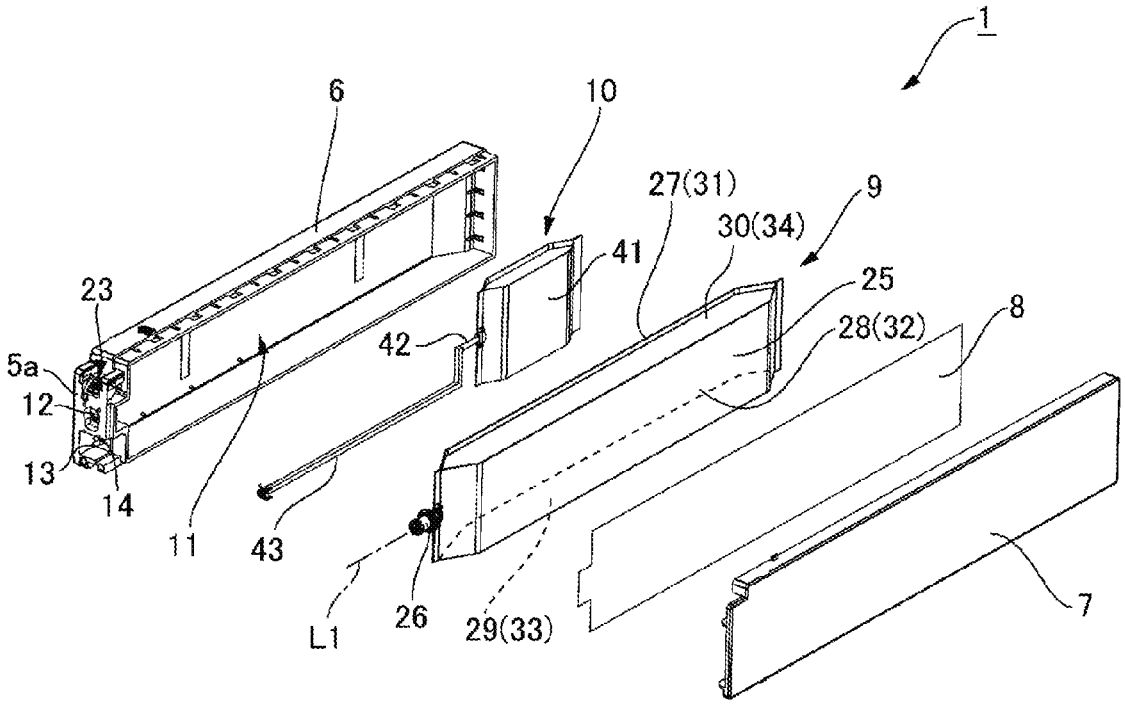
FIGS. 2A and 2B are respectively an exploded perspective view of the cartridge of FIG.1 and a perspective view of an air bag.
Figure 2B:
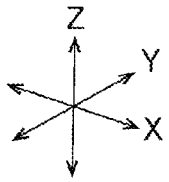
Figure 2B:
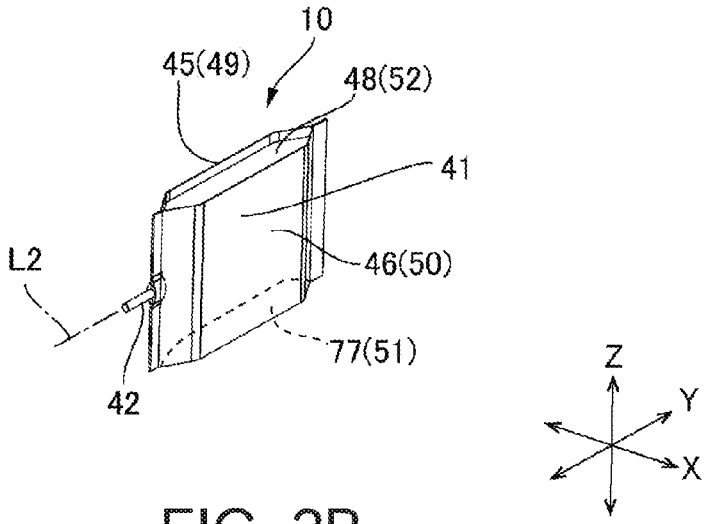

FIG.1A is an appearance perspective view of a cartridge, and FIG. 1B is a front elevational view of the cartridge. FIG.2A is an exploded perspective view of the cartridge, and FIG.2B is a perspective view of an air bag.

A cartridge 1 is mounted to a mounting part 3 of an inkjet printer 2 to supply pigment ink to the inkjet printer 2. The posture of the cartridge 1 shown in FIG.1A is a mounting posture when the cartridge 1 is mounted to the mounting part 3. In the following description, assume that the right-left direction in the mounting posture is a width direction X of the cartridge 1. Assume that a direction that is orthogonal to the width direction X and is a mounting direction when mounting the cartridge 1 to the mounting part 3 is a front-rear direction Y of the cartridge 1. In addition, assume that a vertical direction in the mounting posture is a vertical direction Z of the cartridge 1. The front (front side) of the cartridge 1 is the front (front side) in the mounting direction, and the rear (rear side) thereof is a direction opposite thereto. The left and right of the cartridge 1 is the left and right when the cartridge 1 is viewed from the front.

As shown in FIG.1A, the cartridge 1 is provided with a case 5 having a rectangular parallelepiped shape. The case 5 has a width dimension and a height dimension that are shorter than the length dimension in the front-rear direction Y. In addition, the case 5 has a flattened shape with the width dimension being shorter than the height dimension. The case 5 is provided with a case body 6 of a box type that is positioned on the left, and a lid body 7 that is positioned on the right. The case body 6 and the lid body 7 are made of resin.

As shown in FIG.2A, the opening of the case body 6 is oriented to the right side. The opening of the case body 6 is blocked by a film 8 that is heat-welded to the opening edge of the case body 6. A space surrounded by the case body 6 and the film 8 is a pressurizing chamber 11. An ink pack (liquid storing part) 9 and an air bag (pressing part) 10 are stored in the pressurizing chamber 11. The ink pack 9 is positioned on the right side of the air bag 10. The air bag 10 is arranged on the rear side of the case 5, and is capable of abutting the rear side portion of the ink pack 9. The lid body 7 is fixed to the case body 6 so as to cover the film 8 from the right side.

As shown in FIG.1 B, an ink supply port 12, an air bag-dedicated air flow port (pressing part-dedicated fluid flow port) 13 and a case-dedicated air flow port 14 are formed on a front surface 5*a* of the case 5 (the front surface of the case body 6). The case-dedicated air flow port 14 (pressurizing chamber side fluid flow port) is provided on the right side of the air bag-dedicated air flow port 13. In addition, on the front surface 5*a* of the case 5, positioning holes 17 and 18 are provided at two positions sandwiching the ink supply port 12, the air bag-dedicated air flow port 13 and the case-dedicated air flow port 14 in the vertical direction Z.

A substrate attachment part 19 is provided at the upper end portion of the framountont surface 5*a* of the case 5. The substrate attachment part 19 is provided with a substrate attachment surface 19*a* that is oriented forward and inclined downward. A memory substrate 23 on which a memory 21 and a terminal 22 connected to the memory 21 are implemented is fixed to the substrate attachment surface 19*a*. Information regarding the amount of ink that ink pack 9 is filled with, a filling date when the ink pack 9 was filled with ink, and the like is stored in the memory 21.

Here, the ink stored in the ink pack 9 is pigment ink. The pigment of the pigment ink is dispersed as powder in the solvent.

Ink Pack

As shown in FIG.2A, the ink pack 9 is provided with a flexible ink storing bag 25 for storing ink, and an ink supply tube (liquid supply port) 26 for supply the ink from the ink storing bag 25 to the outside.

The ink storing bag 25 is provided with a first side surface portion 27 positioned on the left side, a second side surface portion 28 positioned on the right side, a lower gusset portion 29 connecting the lower end portion of the first side surface portion 27 and the lower end portion of the second side surface portion 28, and an upper gusset portion 30 connecting the upper end portion of the first side surface portion 27 and the upper end portion of the second side surface portion 28. When the upper gusset portion 30 and the lower gusset portion 29 are folded inward, the ink storing bag 25 has a planar shape of a rectangle that is long in the front-rear direction Y.

Here, the ink storing bag 25 is formed of a first film 31 constituting the first side surface portion 27, a second film 32 constituting the second side surface portion 28, a third film 33 constituting the lower gusset portion 29, and a fourth film 34 constituting the upper gusset portion 30. Adjacent edge portions of the films 31 to 34 are welded together, so as to form a bag-like shape having an opening oriented toward the front. Each of the films 31 to 34 has a laminated structure including a composite barrier layer having a moisture barrier layer and a gas barrier layer, and a welding layer used for joining them. For example, the composite barrier layer includes a moisture barrier layer formed of a resin film on which an inorganic oxide has been vapor deposited, and a gas barrier layer made of an EVOH (ethylene vinyl alcohol copolymer resin). The welding layer is made of PE (polyethylene) or CPP (unstretched polypropylene).

The ink supply tube 26 is attached to the front end portion of the ink storing bag 25. More specifically, the ink supply tube 26 is inserted between the front end edge of the first film 31 and the front end edge of the second film 32 (opening of the ink storing bag 25), and is heat-welded to the first film 31 and second film 32. A central axial line L1 of the ink supply tube 26 extends in the front-rear direction Y (mounting direction).

The ink supply tube 26 is connected to the ink supply port 12 on the front surface 5*a* of the case 5. Here, when the amount of ink in the ink pack 9 decreases due to the ink being supplied to the outside via the ink supply tube 26, the volume of the ink pack 9 decreases while the lower gusset portion 29 and the upper gusset portion 30 fold inward.

Air Bag

The air bag 10 is provided with a flexible air bag body (container) 41 capable of storing air, and an air flow tube 42 for introducing air into the air bag body 41 and putting the air bag body 41 and atmospheric air into communication. The length dimension of the air bag 10 in the front-rear direction Y is less than or equal to half the length dimension of the ink pack 9 in the front-rear direction Y. The height dimension of the air bag 10 is the same as the height dimension of the ink pack 9. The air bag 10 abuts the rear side portion of the ink storing bag 25 from the left side of the ink pack 9.

As shown in FIG.2B, the air bag body 41 is provided with a first side surface portion 45 positioned on the left side in the width direction X, a second side surface portion 46 positioned on the right side, a lower gusset portion 47 connecting the lower end portion of the first side surface portion 45 and the lower end portion of the second side surface portion 46, and an upper gusset portion 48 connecting the upper end portion of the first side surface portion 45 and the upper end portion of the second side surface portion 46.

Here, the air bag body 41 is formed of a first film 49 constituting the first side surface portion 45, a second film 50 constituting the second side surface portion 46, a third film 51 constituting the lower gusset portion 47, and a fourth film 52 constituting the upper gusset portion 48. Adjacent edge portions of the films 49 to 52 are welded together, so as to form a bag-like shape having an opening oriented toward the front. The films 49 to 52 have the same configurations as the films 31 to 34 constituting the ink storing bag 25 of the ink pack 9.

The air flow tube 42 is attached to the front end portion of the air bag body 41. More specifically, the air flow tube 42 is inserted between the first film 49 and the second film 50, and is heat-welded to the first film 49 and second film 50. A central axial line L2 of the air flow tube 42 extends in the front-rear direction Y (mounting direction).

The air flow tube 42 of the air bag 10 is connected to the air bag-dedicated air flow port 13 on the front surface 5*a* of the case 5 via a coupling tube 43.

Mounting of Cartridge to Mounting part

Figure 3:
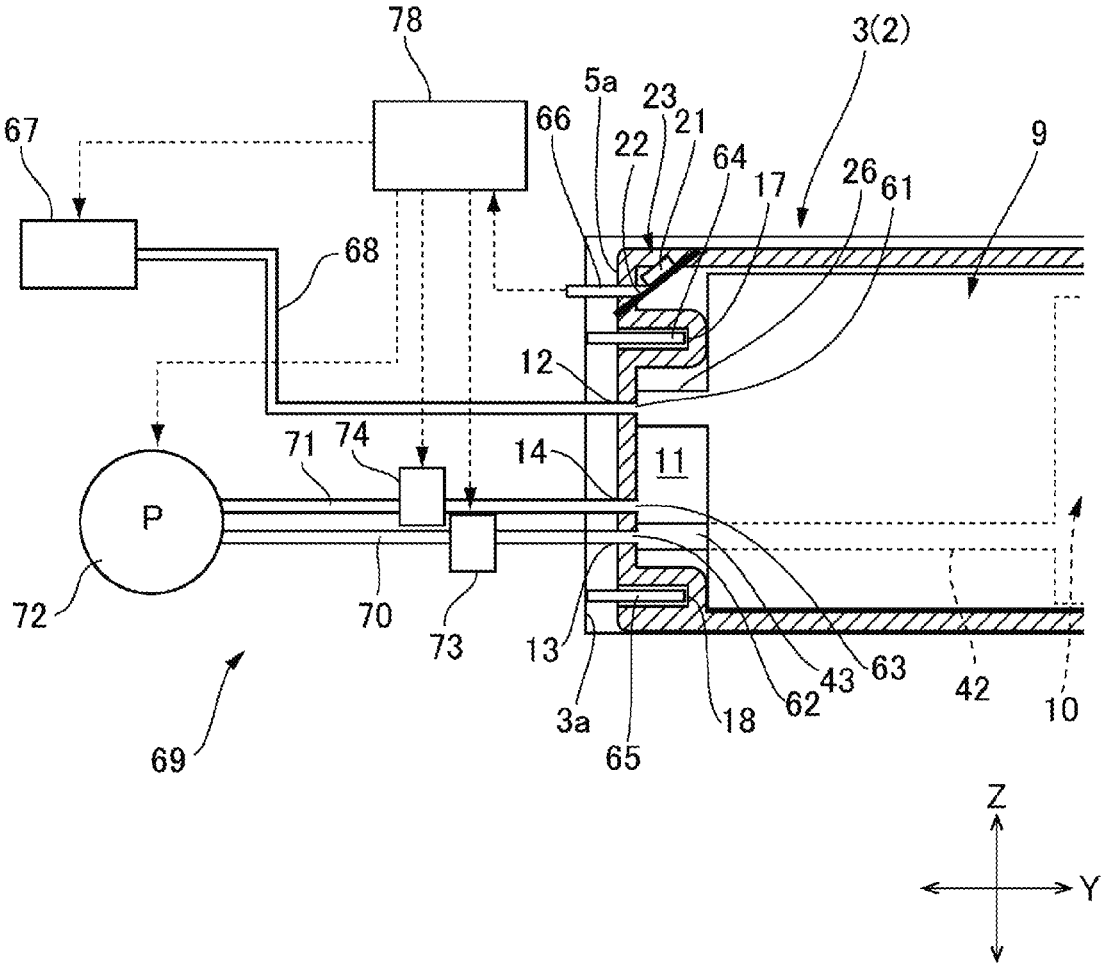
FIG.3 is an explanatory view of a mounting state of a cartridge to an inkjet printer.

FIG.3 is an explanatory view of a state in which the cartridge 1 has been mounted to the mounting part 3 of the inkjet printer 2. The mounting part 3 of the inkjet printer 2 is provided, on a facing surface 3*a* that faces the front surface 5*a* of the cartridge 1, with an ink introduction port 61, a mounting part-side first air flow port 62 and a mounting part-side second air flow port 63 that protrude from the facing surface 3*a*. In addition, the mounting part 3 is provided with a pair of positioning pins 64 and 65 as well as a contact mechanism 66.

The ink introduction port 61 is the upstream end of an ink supply passage 68 for supplying ink to an inkjet head 67. The mounting part-side first air flow port 62 is the downstream end of a first air flow passage 70 of an air supplying mechanism 69 that is mounted to the inkjet printer 2. The mounting part-side second air flow port 63 is the downstream end of a second air flow passage 71 of the air supplying mechanism 69. The pair of positioning pins 64 and 65 are provided at two positions sandwiching the ink introduction port 61, the mounting part-side first air flow port 62 and the mounting part-side second air flow port 63 in the vertical direction Z. The positioning pins 64 and 65 protrude from the facing surface 3*a* in the mounting direction (the front-rear direction Y) of the cartridge 1.

The air supplying mechanism 69 is provided with a pressurization pump 72, the first air flow passage 70, the second air flow passage 71, a first valve 73 provided midway in the first air flow passage 70, and a second valve 74 provided midway in the second air flow passage 71. The pressurization pump 72 is connected to the upstream ends of the first air flow passage 70 and the second air flow passage 71. A control unit 78 of the inkjet printer 2 for performing printing operations controls driving of the pressurization pump 72, the first valve 73 and the second valve 74.

The first valve 73 is displaced between a closed position at which the first air flow passage 70 is blocked, an open position at which the pressurization pump 72 and the mounting part-side first air flow port 62 are put into communication, and an atmospheric air open position at which the mounting part-side first air flow port 62 and atmospheric air are put into communication via the first valve 73. The second valve 74 is displaced between a closed position at which the second air flow passage 71 is blocked, an open position at which the pressurization pump 72 and the mounting part-side second air flow port 63 are put into communication, and an atmospheric air open position at which the mounting part-side second air flow port 63 and atmospheric air are put into communication via the second valve 74.

When the cartridge 1 is mounted to the mounting part 3, the tip ends of the pair of positioning pins 64 and 65 are first inserted into positioning holes 17 and 18 of the cartridge 1. Thereby, the cartridge 1 is placed in a state in which the position thereof in the vertical direction Z and width direction X is restricted. After that, when the cartridge 1 is pushed forward into the mounting part 3, the ink supply port 12 of the cartridge 1 is connected to the ink introduction port 61. At the same time, the air bag-dedicated air flow port 13 of the cartridge 1 is connected to the mounting part-side first air flow port 62, and the case-dedicated air flow port 14 is connected to the mounting part-side second air flow port 63.

In addition, in the state where the cartridge 1 is mounted to the mounting part 3, the contact mechanism 66 is electrically connected to the terminal 22 of the memory substrate 23. Thereby, the control unit 78 can read information from the memory 21 and write information to the memory 21.

Ink Supply Operations

Figure 4A:
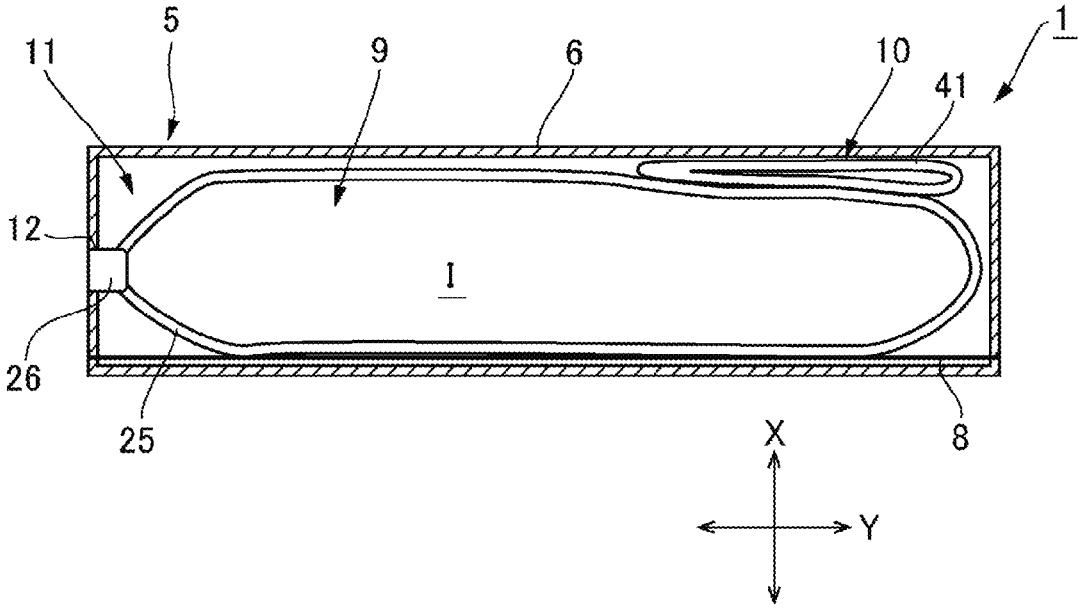
FIGS. 4A and 4B are explanatory views of an ink supplying operation in the case where the ink amount is high.
Figure 4B:
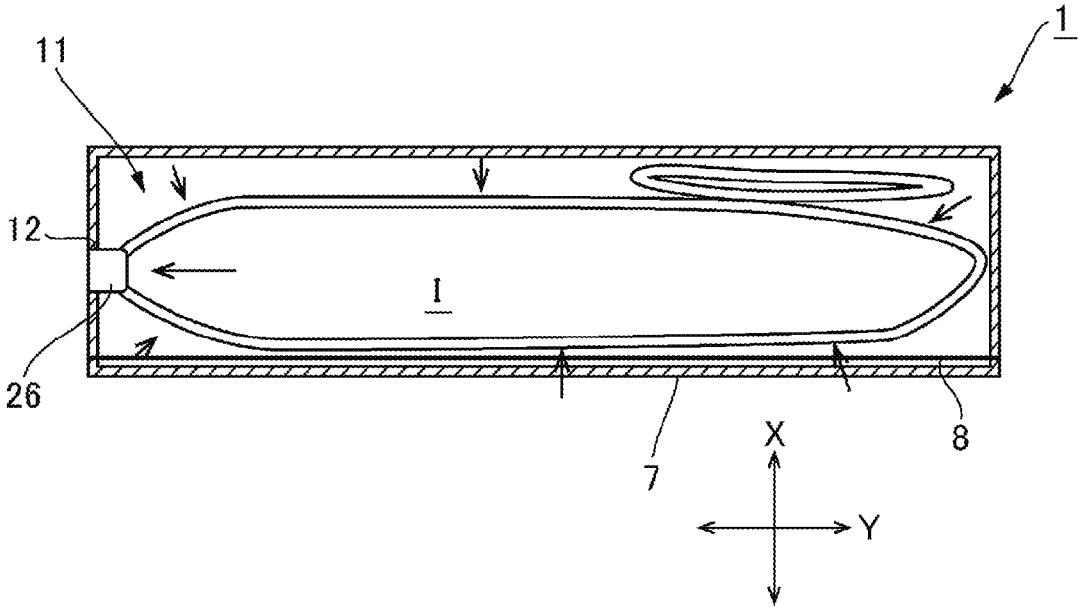
Figure 5A:
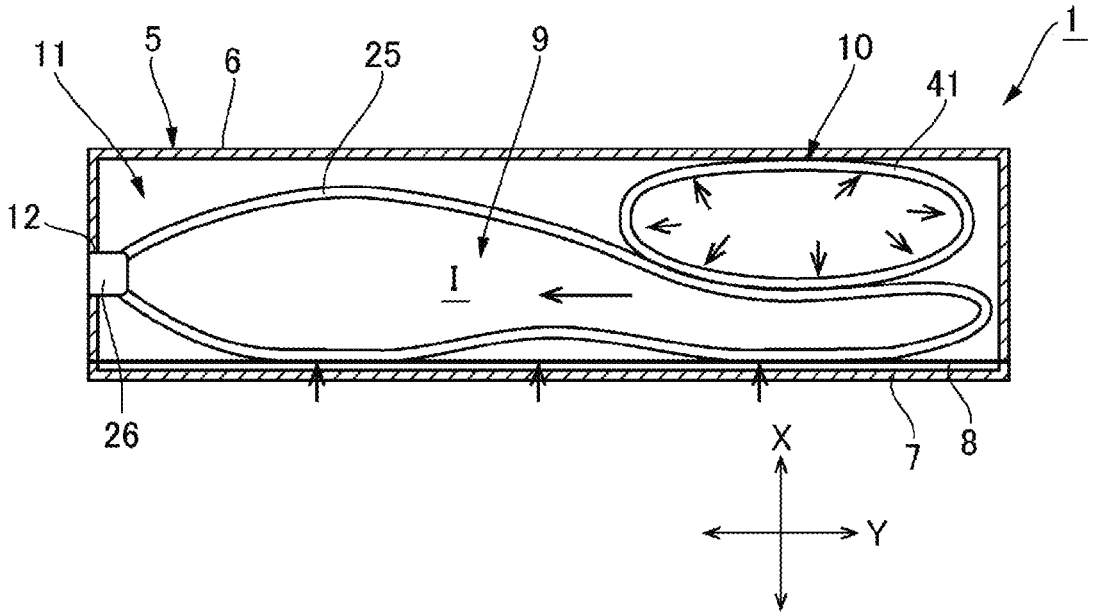
FIGS. 5A and 5B are explanatory views of an ink supplying operation in the case where the ink amount is low.
Figure 5B:
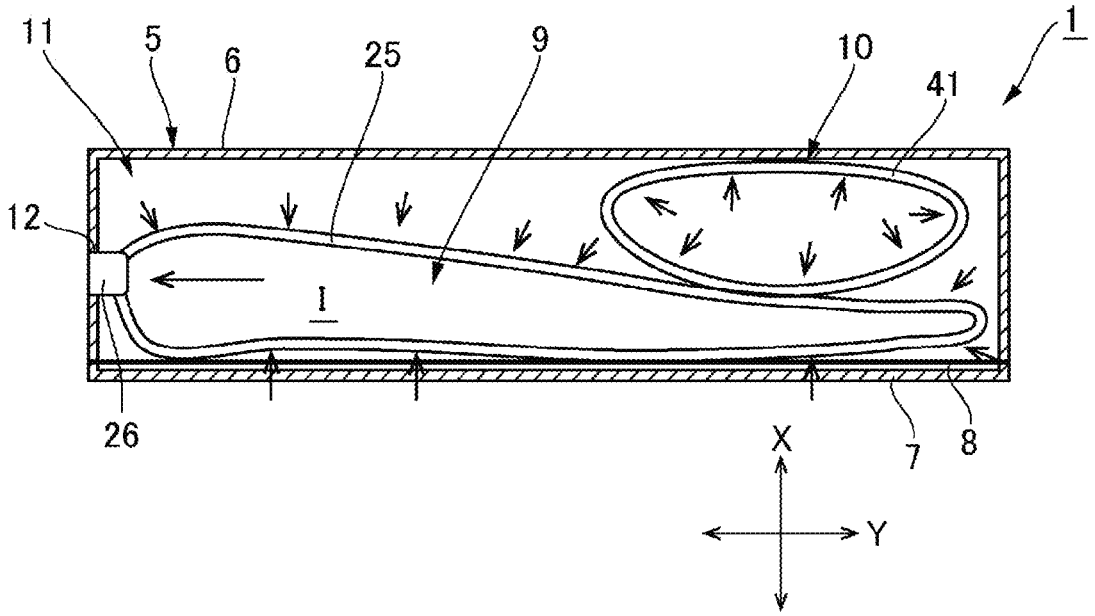

Next, ink supply operations from the cartridge 1 to the inkjet printer 2 will be described with reference to FIGS. 3 to 5B. FIGS. 4A and 4B are explanatory views of a first ink supply operation in the case where the amount of ink in the ink pack 9 is high. FIGS. 5A and 5B are explanatory views of a second ink supply operation in the case where the amount of ink in the ink pack 9 is low. In FIGS. 4A, 4B, 5A and 5B, cross sections taken by cutting the cartridge 1 along a plane that is orthogonal to the vertical direction Z are shown. FIG.4A shows a state before the ink is supplied, and FIG.4B shows a state in which the ink is being supplied.

First, when the inkjet printer 2 is in a waiting state of waiting for supply of printing data, the first valve 73 and the second valve 74 are arranged at the atmospheric air open positions. Therefore, as shown in FIG.4A, the air bag 10 and the pressurizing chamber 11 are open to atmospheric air.

During printing, when ink I is supplied from the cartridge 1 to the inkjet printer 2, the control unit 78 performs the first ink supply operation or the second ink supply operation. The first ink supply operation is performed in the case where the ink amount is higher than a specified amount (set liquid amount) determined in advance. The second ink supply operation is performed after the ink amount has fallen below the specified amount. The first ink supply operation or the second ink supply operation is selected accordingly depending upon the kind of ink in the ink pack 9, in the case where the amount of ink in the ink pack 9 is the same as the set liquid amount.

In the first ink supply operation, the control unit 78 causes the second valve 74 to be arranged at the open position so as to put the pressurization pump 72 and the mounting part-side second air flow port 63 into communication. In addition, the control unit 78 drives the pressurization pump 72. Thereby, pressurized air is introduced from the second air flow passage 71 into the case 5 via the mounting part-side second air flow port 63 and the case-dedicated air flow port 14. Accordingly, the pressurized air is introduced into the pressurizing chamber 11. Note that the first valve 73 is arranged at the atmospheric air open position.

When the air is introduced into the pressurizing chamber 11, as shown by an arrow in FIG.5B, the ink pack 9 is pressurized from outside. Therefore, the ink I in the ink storing bag 25 is supplied to the inkjet head 67 via the ink supply tube 26, the ink supply port 12, the ink introduction port 61 of the mounting part 3 and the ink supply passage 68.

When printing ends, the control unit 78 stops the pressurization pump 72. In addition, the control unit 78 causes the second valve 74 to be arranged at the atmospheric air open position. Therefore, the mounting part-side second air flow port 63 is put into communication with atmospheric air, and the pressurizing chamber 11 is opened to atmospheric air. Accordingly, the inkjet printer 2 returns to the waiting state shown in FIG.4A.

In the second ink supply operation, the control unit 78 first causes the first valve 73 to be arranged at the open position. That is, the control unit 78 drives the first valve 73 so as to put the pressurization pump 72 and the mounting part-side first air flow port 62 into communication. After that, the control unit 78 drives the pressurization pump 72. Accordingly, pressurized air is introduced from the first air flow passage 70 into the air bag 10 via the mounting part-side first air flow port 62 and the air bag-dedicated air flow port 13. Here, the second valve 74 is arranged at the atmospheric air open position. Therefore, the pressurizing chamber 11 is opened to atmospheric air.

When the air is introduced into the air bag 10, as shown in FIG.5A, the internal pressure of the air bag 10 becomes higher than the internal pressure of the case 5, and the air bag body 41 of the air bag 10 expands. Therefore, the air bag 10 presses the rear side portion of the ink pack 9. Accordingly, the ink pack 9 is pressed against the lid body 7 (film 8), and is put into a state in which the rear side portion thereof is crushed. As a result, the ink I in the ink pack 9 moves from the rear side portion to the front side portion. In addition, the internal pressure of the ink pack 9 increases.

Next, the control unit 78 causes the first valve 73 to be arranged at the closed position so as to block the first air flow passage 70. Accordingly, the air bag 10 is maintained in a state in which the internal pressure thereof is increased. In addition, in parallel with blocking the first air flow passage 70, the control unit 78 causes the second valve 74 to be arranged at the open position so as to put the pressurization pump 72 and the mounting part-side second air flow port 63 into communication. Accordingly, pressurized air is introduced from the second air flow passage 71 into the pressurizing chamber 11 via the mounting part-side second air flow port 63 and the case-dedicated air flow port 14.

When the air is introduced into the case 5, the ink pack 9 is pressurized from outside as shown by arrows in FIG.5B. Therefore, the ink I in the ink storing bag 25 is supplied from the ink supply port 12 to the inkjet head 67 via the ink introduction port 61 of the mounting part 3 and the ink supply passage 68.

Here, the internal pressure of the pressurizing chamber 11 (pressure due to the air introduced into the pressurizing chamber 11) is controlled to be lower than or equal to the internal pressure of the air bag 10 (pressure of the air introduced into the air bag 10). In other words, the internal pressure of the air bag 10 is maintained at a pressure higher than or equal to the internal pressure of pressurizing chamber 11. Therefore, the air bag 10 does not contract due to the introduction of air into the pressurizing chamber 11.

As a result, the ink pack 9 is pressurized from outside in the state in which the rear side portion thereof is pressed by the air bag 10. That is, the ink pack 9 is in the state in which the internal pressure thereof is increased by the air bag 10 and is further pressurized from outside. Accordingly, even in the case where the amount of the ink in the ink pack 9 becomes low, the pressure for supplying the ink to the inkjet printer 2 does not decrease.

In addition, in this example, in the state where the internal pressure of the pressurizing chamber 11 is low due to being opened to atmospheric air, air is introduced into the air bag 10 so as to cause the air bag body 41 to expand, and subsequently the internal pressure of the pressurizing chamber 11 is caused to rise. Therefore, it is easy to cause the air bag body 41 to expand. Accordingly, it is easy to press the ink pack 9 using the air bag 10.

Furthermore, in this example, the introduction of air into the air bag 10 and the introduction of air into the pressurizing chamber 11 are performed using the same pressurization pump 72, and thus the manufacturing cost can be suppressed by the inkjet printer 2 having a simple structure.

Other Embodiments

Note that when pressurized air is introduced into the pressurizing chamber 11 in the second ink supply operation, the control unit 78 may cause the first valve 73 to be arranged at the open position. In this case, the internal pressure of the air bag 10 is maintained at a pressure higher than or equal to the internal pressure of the pressurizing chamber 11 by continuing the introduction of air into the air bag 10.

In addition, in the above-described example, in the second ink supply operation, the introduction of air into the pressurizing chamber 11 is performed after the introduction of air into the air bag 10 ends (after pressurization of the air bag 10 is completed). However, the introduction of air into the air bag 10 and the introduction of air into the pressurizing chamber 11 may be simultaneously started. In this case, the pressure loss of the air introduced into the air bag 10 is reduced to a pressure loss lower than the pressure loss of the air introduced into the pressurizing chamber 11, and thereby the time point when pressurization of the air bag 10 is completed is made earlier than the time point when pressurization of the pressurizing chamber 11 is completed.

For example, the flow passage area of the first air flow passage 70 when the first valve 73 is arranged at the open position is made larger than the flow passage area of the second air flow passage 71 when the second valve 74 is arranged at the open position. Then, when the second ink supply operation is started, the first valve 73 and the second valve 74 are simultaneously arranged at the open positions, and the introduction of air into the air bag 10 and the introduction of air into the pressurizing chamber 11 are simultaneously performed. Thereby, pressurization of the pressurizing chamber 11 can be completed after pressurization of the air bag 10 is completed.

Note that in the above-described example, the air bag 10 is arranged lateral to the rear side portion of the ink pack 9, however, a configuration may be adopted in which the air bag 10 is arranged above the rear side portion of the ink pack 9, and the air bag 10 crushes the ink pack 9 from above.

In addition, it is possible to press the ink pack 9 using a plurality of air bags. Here, in the case where a plurality of air bags 10 are provided, the plurality of air bags 10 can be arranged at positions sandwiching the ink pack 9 in the width direction X. Alternatively, the plurality of air bag 10 can also be arranged at positions sandwiching the ink pack 9 in the vertical direction Z.

What is claimed is:

1. A cartridge that is mountable to a liquid jetting apparatus to supply a liquid, the cartridge comprising:

a liquid storing part having a liquid container that stores the liquid;

a pressing part having a flexible container capable of abutting the liquid container; and a pressurizing chamber that stores the liquid storing part and the pressing part, the liquid storing part including a liquid supply port for supplying the liquid from the liquid container to the outside, the pressing part including a pressing part side fluid flow port for introducing a fluid into the flexible container, the pressurizing chamber including a pressurizing chamber side fluid flow port that introduces a fluid into the pressurizing chamber, and the liquid supply port and the pressing part side fluid flow port extending in a direction in which the cartridge is mounted to the liquid letting apparatus.

2. The cartridge according to claim 1, having:

a first state in which the fluid is introduced from the pressurizing chamber side fluid flow port into the pressurizing chamber in a case where a liquid amount of the liquid storing part is higher than a set liquid amount that was set in advance; and a second state in which the fluid is introduced from the pressing part side fluid flow port into the pressing part in a case where the liquid amount of the liquid storing part is lower than the set liquid amount.

3. The cartridge according to claim 1, wherein the liquid supply port is attached to a front end portion of the liquid container in a mounting direction, and the pressing part is capable of abutting a rear side portion of the liquid storing part in the mounting direction.

4. The cartridge according to claim 1, wherein pressing force of the pressing part pressing the liquid container due to fluid introduction is larger than or equal to an internal pressure of the pressurizing chamber.

5. A liquid supplying method for supplying a liquid from a cartridge that is mounted to a liquid jetting apparatus, the cartridge including a liquid storing part having a liquid container that stores the liquid;

a pressing part having a flexible container capable of abutting the liquid container; and a pressurizing chamber that stores the liquid storing part and the pressing part, the liquid storing part including a liquid supply port for supplying the liquid from the liquid container to the outside, the pressing part including a pressing part side fluid flow port for introducing a fluid into the flexible container, the pressurizing chamber including a pressurizing chamber side fluid flow port that introduces a fluid into the pressurizing chamber, and the liquid supply port and the pressing part side fluid flow port extending in a direction in which the cartridge is mounted to the liquid jetting apparatus, the liquid supplying method comprising:

introducing a fluid into the flexible container via the pressing part side fluid flow port to cause the flexible container to expand and press the liquid container; and introducing a fluid into the pressurizing chamber via the pressurizing chamber side fluid flow port to cause the liquid container to contract and supply the liquid from the liquid supply port to the liquid jetting apparatus.

6. The liquid supplying method according to claim 5, wherein the pressurizing chamber side fluid flow port is put into communication with atmospheric air and the pressurizing chamber is opened to atmospheric air before the fluid is introduced into the flexible container.

7. The method for supplying a liquid according to claim 5, wherein the fluid is introduced into the flexible container via the pressing part side fluid flow port after the liquid amount of the liquid in the liquid storing part falls below a set liquid amount that was set in advance.

* * * * *